United States Patent [19]

Milles

[11] 4,279,136

[45] Jul. 21, 1981

[54] COMBINATION LOCK FOR SUITCASES, BAGS OR THE LIKE

[75] Inventor: Peter Milles, Steimel-Alberthofen, Fed. Rep. of Germany

[73] Assignee: S. Franzen Sohne (GmbH & Co.), Fed. Rep. of Germany

[21] Appl. No.: 45,428

[22] Filed: Jun. 4, 1979

[30] Foreign Application Priority Data

Jun. 26, 1978 [DE] Fed. Rep. of Germany ..... 2828057
Feb. 17, 1979 [DE] Fed. Rep. of Germany ..... 2906144

[51] Int. Cl.[3] ..... E05B 65/52; E05B 37/02
[52] U.S. Cl. ..... 70/71; 70/312
[58] Field of Search ..... 70/2, 3, 5, 67–76, 70/312

[56] References Cited

U.S. PATENT DOCUMENTS 3,736,778 6/1973 Beko ..... 70/74

*Primary Examiner*—Robert L. Wolfe
*Attorney, Agent, or Firm*—Gottlieb, Rackman & Reisman

[57] ABSTRACT

A combination lock for suitcases, bags, or the like, is disclosed, in which a plurality of engageable blocking sleeves and corresponding number-setting dials cooperate with a latching slide member to permit the selective latching or unlatching of the device. The invention includes a separate portion of the latching slide member resiliently urged to the latched position, and which independently permits latching of the device even when the opening combination is not set on the number-setting dials. The device also facilitates resetting of the secret combination, and provides the further option of selectively blocking the latching function.

3 Claims, 7 Drawing Figures

COMBINATION LOCK FOR SUITCASES, BAGS OR THE LIKE

This invention relates to a combination lock for suitcases, bags, or the like, in which individual blocking sleeves and number-setting dials are arranged on a shaft. The blocking sleeves, which can be disengaged by axially shifting from the number-setting dials and be fixed in this position, establish engagement slots when the opening combination is set and the axial shift takes place. Those slots are then located in a position opposite to the fingers of a latching slide member of the lock, which can be shifted axially by external actuation against the force of a spring. This enables the fingers to enter the engagement slots of the blocking sleeves when the lock's open position is attained. The latching slide member is also provided on its end with a slidable latching portion which snaps in catch-like fashion into a hasp on the suitcase or other luggage piece.

A combination or permutation lock of this type is known, for instance, from the German Pat. No. 1,678,066. The disadvantage of such existing combination locks is that the latching function is only possible when the number combination has been set correctly, that is, when the fingers of the ladder-shaped latching slide member can fit into the engagement slots of the blocking sleeves, which are formed in the prior art by a flattening of the blocking sleeve collars or flanges. Without any provision for having the latching member withdrawn, the hasp may be vigorously hit with the latching portion in the locked position, thereby risking possible destruction of the lock.

Furthermore, it happens quite often in combination locks that the blocking sleeves snap into place automatically when the device is tampered with, thereby resulting in undesired opening of the latching slide member. Such an unsecured condition occurs, for example, when the blocking edge of a finger of the latching slide member, due to unfavorable tolerance dispersions, intersects the corresponding flattened edge of a blocking sleeve (which is designed to permit movement of the slide member). This situation is further contributed to by occasional axial "play" between the flattened portion of the blocking sleeve and the latching slide member above it. Often, the blocking sleeves are mounted on the main shaft of the lock with considerable self-play, and there frequently exists substantial radial play around the shaft which adversely affects the normal rotational blocking engagement between the blocking sleeve and the number-setting dial. Thus, even with the number-setting dial locked in place, a relatively large angular displacement of the blocking sleeve in relation to the dial is still possible. In addition, the internal gears of the number-setting dials may exhibit deviations in pitch in relation to external teeth. Since these parts are, almost without exception, manufactured by an injection molding process, the foregoing imperfections can certainly cause improper lock operation. All these factors can lead to tolerance pairings, which impair the safety of use of this type of combination lock.

This invention is intended, in addition to the functions stated in this specification and the appended claims, to provide a permutation lock of its class of such a simple construction and a design so safe to use, that the number combination has to be set only for opening; consequently, immediate recoding is permitted. Also achieved with this invention is that despite the usual imprecision and wide tolerances, inherent in the manufacturing process, undesired automatic self-locking is prevented with a high degree of certainty.

As a consequence of the design of this invention, a combination lock of increased value of use and safety has been produced. The latch-engagement function can be attained independently of the respective operating state of the combination lock safely and without the danger of destroying the internal works. The main latching slide member has a separate latching portion which is capable of axial sliding movement relative to the latching slide member, against the biasing action of a spring, in the opening direction for the lock. For all practical purposes, the latching slide member itself constitutes a trailing latch in the lock's operation. The foregoing relationship permits the lock to close even if the correct combination for opening it has not been set. When the suitcase or the like is open, the number-setting dials can therefore be changed without trouble in order to avoid revealing the secret combination, and only when the opening of the lock is to take place again (i.e., by actuation of the latching slide member), must the correct combination of numbers be set on the dial. This arrangement overcomes the problems caused by the typical latching portion found in the aforementioned prior art. There, the operator usually fails to notice (or be assured) that the ready-for-engagement condition is absent, and because he may be diverted in view of the rather large surface dimensions of the hasp, he may inadvertently force the latching portion down on the hasp. This can result in bending of the latching portion, which may cause jamming during the sliding or can lead to complete destruction of the lock. Despite this latch-function operation, the recoding of the combination can be performed efficiently, in particular also by using a flange portion of the blocking sleeves to prevent the opening movement of the latching slide portion.

Whereas initially, the suitcase may be closed in any desired position of the number-setting dials, this procedure will no longer be possible when the blocking sleeves have been disengaged from the setting dials, that is, when set in the combination resetting phase of the device. Any tampering with this process will certainly be noticed. The latching function will take effect again only after completion of the resetting and restoration of the sleeves to their respective dials.

The means of construction of this device have been kept extremely simple, and there is no need for additional components (in number) than have been used in the prior art. The latching portion, and one of the blocking sleeves directly adjacent to it, are brought only so close together in construction that the disengagement path of the blocking sleeves, which can be shifted in the direction of the latching portion, intersects the latching portion and prevents it from avoiding the blocking sleeves. Blocking of the opening movement of the latching portion occurs in the disengaged state of the blocking sleeves, and is attributable to the fact that the blocking sleeve flange portion occupies the two individual engagement slots adapted to accommodate the two locking fingers of the latching slide member, these fingers terminate at a distance from each other, and are arranged opposite each other, comparable to the positioning of the engagement slots. This type of design can be common to all the blocking sleeves. The locking fingers of the latching slide member form locking surfaces which are spatially separated from each other. The contacting surface of the latching portion can pass unobstructed through the space present between the opposed fingers of the latching slide member.

The requirement of separately engaging the locking fingers in the corresponding individual engagement slots brings a substantial gain in safety. Even if one locking finger, due to unfavorable tolerances, lies flush with its associated individual engagement slot of the blocking sleeve, the other locking finger and slot remain effective for blocking purposes. Generally speaking, accidental self-locking is avoided by the different and opposed location of the locking fingers, even if the number-setting dials were not locked, as they should be, in one or the other adjacent position. This results in greater independence from tolerance variations. Another advantage is the resultant possibility with this invention of relocating the individual engagement slots further into the axial plane for dual blocking capability. With the tangential flattening of the blocking sleeve flange in the prior art, the region between individual engagement slots is unavailable for use as a blocking surface.

In order to obtain an optimally adapted spring arrangement for the latching slide member and for the resetting technique for the "secret" combination, the invention provides two springs, acting in opposite directions and independently from each other. The springs are located in the space (or chamber) which the blocking sleeve closest to the latching slide portion enters when disengaged from its corresponding number dial. One of these springs acts against the blocking sleeves and the other biases the latching portion. The actuation of the latching slide member is thereby facilitated to the extent that the spring force usually resisting the recoding of the combination does not have to be overcome. In this way, an easily movable spring suspension can be attained for the latching slide member, which can thereby be manipulated by smaller elements; similarly, potentially painful pressure points on the fingers of the operator are avoided. This previously occurred especially with heavily adorned relief-like operating structures of the prior art.

The other spring, which acts on the blocking sleeves, may be of greater force, so that the possibility of an independent and undesired change of the opening combination (for instance as the result of accidental touching of the setting feature and contents of the suitcase), is precluded in this case. The spring acting on the blocking sleeves has also been located and mounted in a stable position, since at least this spring is braced against an intermediate wall projecting into the respective accommodating space for the springs and extending to almost below the main lock shaft. This wall is secured in position by the shaft extending laterally above it. At the same time, the wall is a partition which forms the supporting base for a blocking sleeve spring acting in the opposite axial direction. This spring may advantageously be designed in the shape of a hairpin spring, or alternatively as a helical spring. In contrast, the spring acting on the latching portion is designed in the form of a forked leaf spring, which also braces itself against the partitioning wall. As a convenience in construction, the positioning of the prong ends of the forked leaf spring in front of openings in the side wall of an internal casing for the lock, results in extremely easy assembly. The springs do not have to be pressed away in order to permit insertion of the flanges depending from the latching portion; rather, open insertion shafts remain in front of the lock wall casing there.

A further advantage is that the latching portion includes two generally parallel guide prongs originating from a bridge member, with the guide prongs extending along both sides of the number-setting dials. These prongs guarantee an uncanted, easy-moving guidance of the latching portion and do not require any enlargement of the lock casing, since they are advantageously spaced on both sides of the number-setting dials and are accommodated in the normally unused corners of the casing. The inner walls of the lock housing can thereby be used most favorably for guidance, and can still accommodate the latching slide member bearing the latching portion and the front plate of the combination lock as well.

Another favorable feature of this invention is that the flanges for the springs which bear against the common partitioning wall, and directed inward (i.e., toward the lock's main shaft), from the plate bridge member, are formed at an angle. The spring flanges extend to the sides of the shaft and also provide a favorable biasing for the latching portion, precisely in the area of high mechanical stress. Finally, a favorable stabilizing feature exists with this invention in that the latching slide member includes, beneath and axially behind the latching portion, a projection which serves to underpin the latching portion, thus lending it support.

Additional advantages and details of this invention are explained hereinafter in greater detail in connection with an illustrative embodiment as shown by the drawings, wherein.

Figure 2:
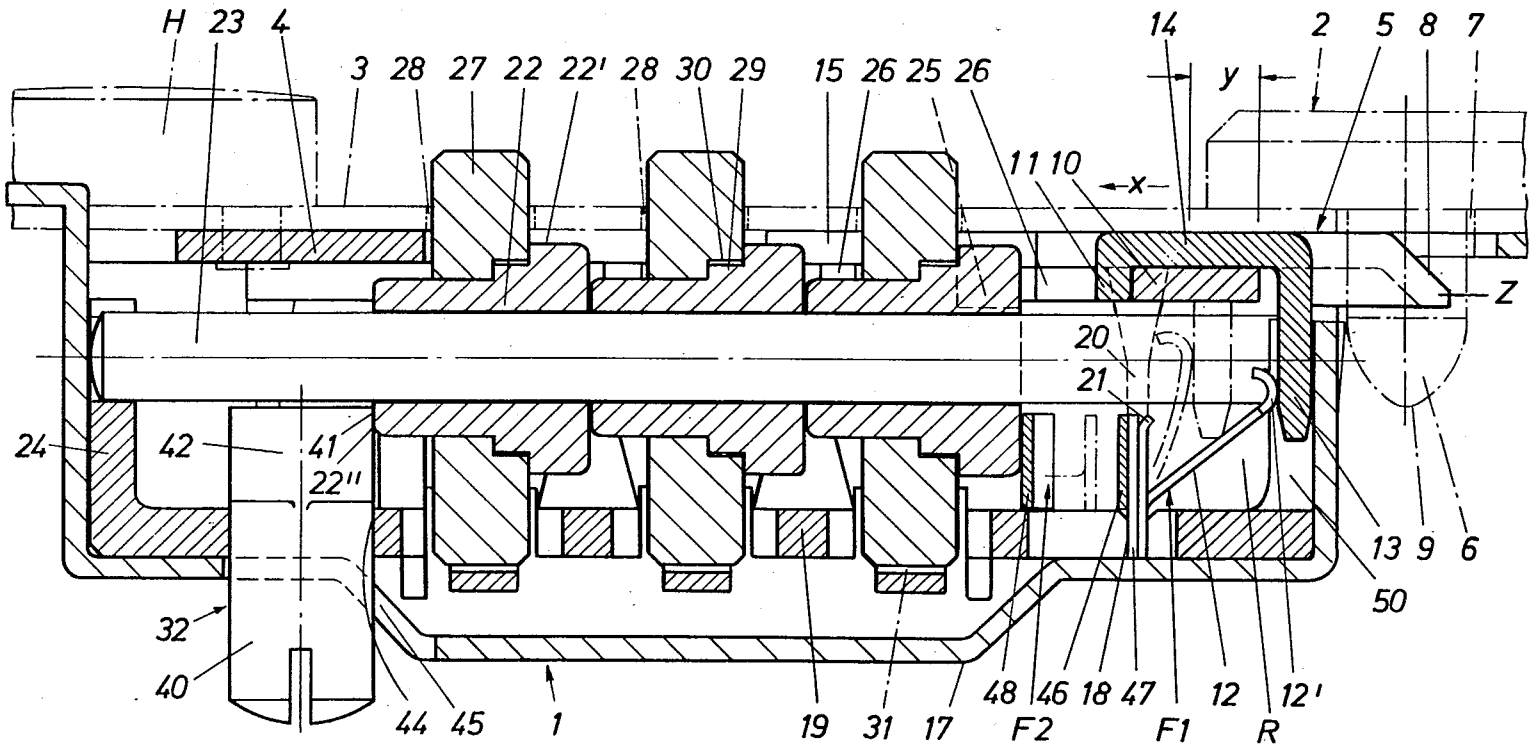
FIG. 2 is a longitudinal sectional view through the combination lock shown in FIG. 1.
Figure 3:
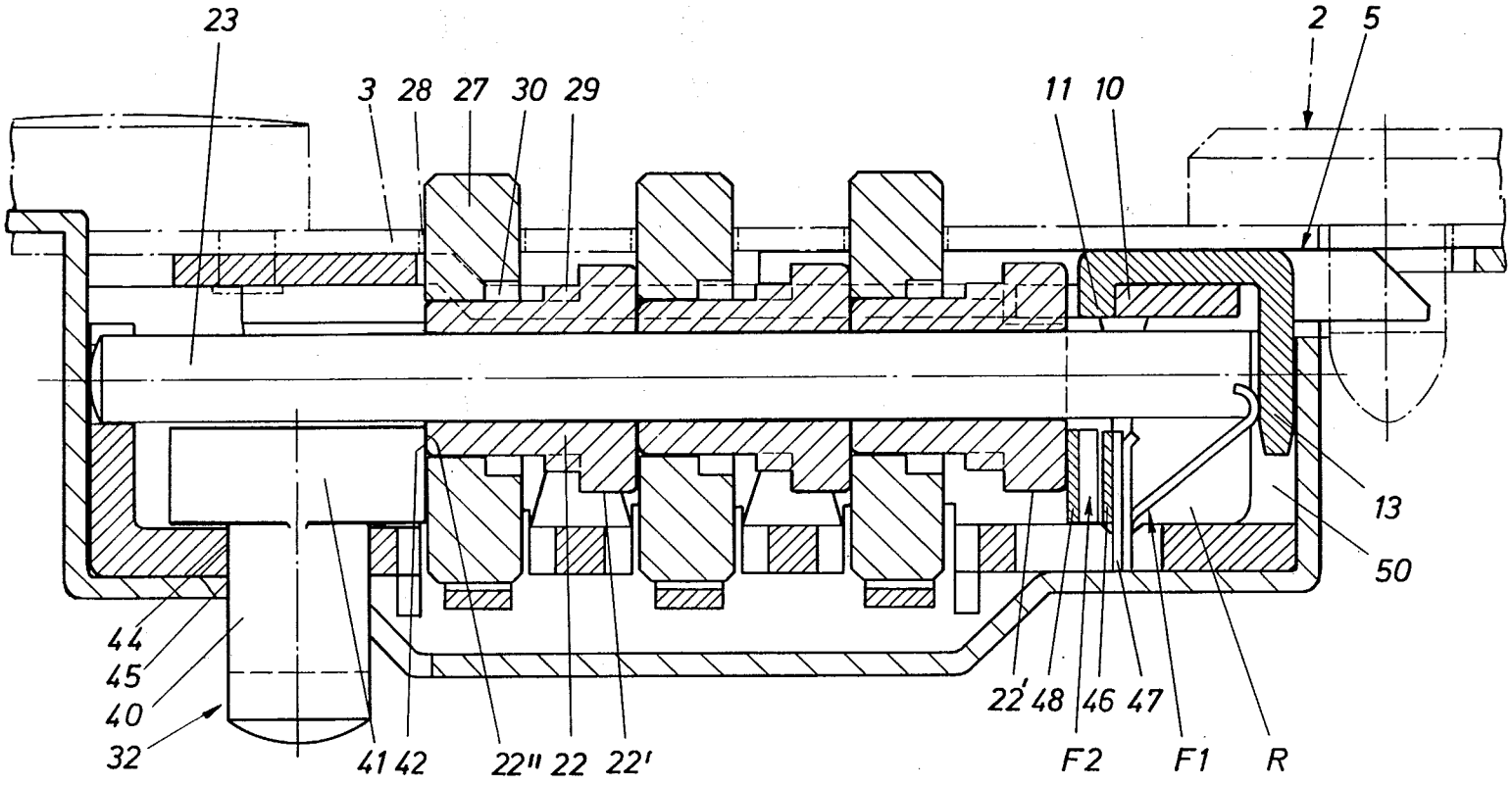
FIG. 3 is a longitudinal sectional view in FIG. 2, but with the blocking sleeves disengaged from their number-setting dials for the purpose of changing the opening combination for the lock.

The combination lock of this invention consists of a permutation lock portion 1 and a hasp assembly serving as a counterlocking part 2 (see FIGS. 2 and 3). The permutation lock portion 1 is closed on top with a front plate 3, below which lies a latching slide member 4 which is movable in a longitudinal direction. Toward hasp 2, latching slide member 4 carries a latching portion 5 designed in the form of a separately movable dragging latch. The catch on the hasp side of the latching portion 5 snaps into eye 6 of hasp 2 (at the right in FIGS. 2 and 3). A bore 7 is provided in the front plate to accommodate the eye 6. The sloping surface of the catch is identified at 8, and it is noted that the underside of the eye 6 is rounded off transversely, as shown at 9 in FIG. 2. When this transversely rounded part 9 impacts against sloping catch surface 8, the latching portion 5 is pushed back against the force of latching portion spring F1 in the direction of the arrow "x"; at the same time, there is no corresponding shift in position of the latching slide member 4. The latching portion 5 is, toward this end, independently movable through dimension "y" in the lock-opening direction, although portion 5 is coupled to the latching slide member 4, which is also longitudinally movable.

The latching portion 5, which is formed by a flat piece of material and is movable in a straight line, has, at the end remote from the catch, a drag-hook 11 which abuts a plate bridge 10 of the latching slide member 4. The latter is beveled towards the inside of the lock. The plate bridge 10 of the latching slide member 4 extends, on the side closer to the catch, in the form of a projection 33, so as to provide the effective support for the freely projecting tongue Z of the latching portion 5, such support being located as far "outside" of the lock structure as possible. In addition, flanges 13 of the latching portion bear against the legs 12 of the latching portion spring F and depend downwardly at an angle from the end of the latching portion 5 at the catch side. The fork prong ends 12' of the spring legs 12, which are founded by being rolled inward, rest against the bearing flanges 13. The latching portion 5 is formed, in the direction of arrow "x", with two guide-prongs 15 originating from plate bridge 14. The outer surfaces 15' of prongs 15 are guided by and move against the corresponding edges of longitudinal wall sections 16 of lock casing 17. To avoid undesired hooking, the prong ends 15 are shaped as abutting inclines. The guide-prongs 15 extending from the plate bridge 14 provide the latching portion 5 with a length dimension corresponding approximately to the overall width of the latching portion.

Figure 1:
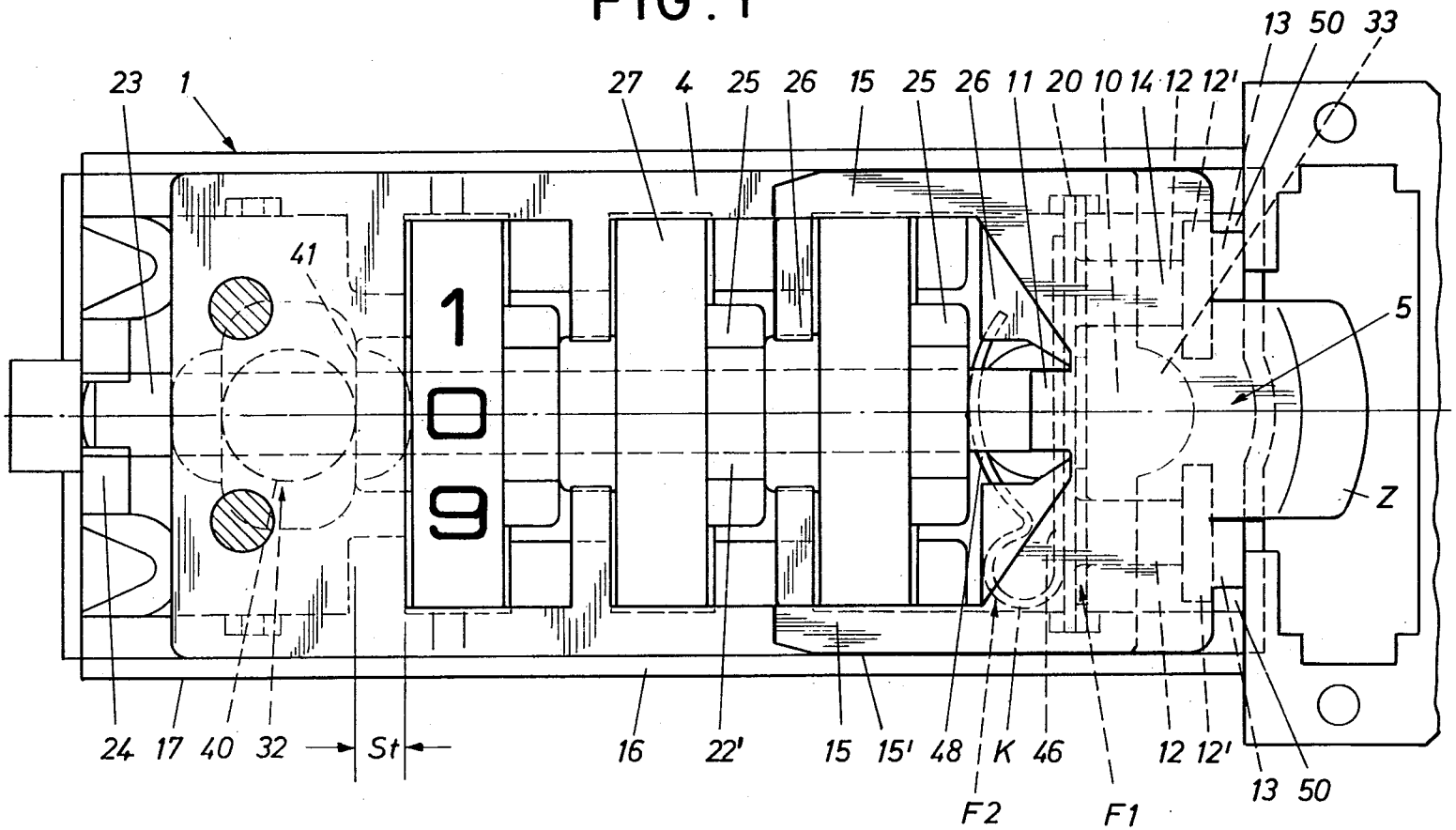
FIG. 1 is an enlarged top plan of the combination lock designed pursuant to the invention, with the front plate taken off.

The latching portion spring F1 is inserted in the space R of the lock casing 17, which is near the latching portion 5; spring F1 fits into a transverse slot 18 at the bottom of a box-like support insert 19. Transverse slot 18 extends upwardly into lateral slots 20 (FIGS. 1 and 2). The insert 19 is illustratively fashioned of plastic material. The lateral slots 20 have different preferred directions for inserting the spring F1 therein. The adjustment of the height of latching portion spring F1 is made by aligning the spring's outer claws 21 with adjacent wall 47. The claw legs 12 of this spring also act to bias the latching slide member 4.

The combination lock of this invention is equipped with both a locking and a "secret" combination-resetting device. This device consists of several sleeves 22, each mounted on central shaft 23. The shaft 23 is journaled at one end in free-standing front walls 24 of insert 19. The front ends of walls 24 abut against the transverse wall of the lock casing 17 which is external to the insert walls. Each blocking sleeve 22 is provided with two individual engagement slots 25, which act in conjunction with shiftable locking fingers 26, which terminate at a distance of each other, thus leaving an open space between them. The locking fingers 26 are formed by projecting sections of the latching slide member 4 which slope slightly down and inwardly from longitudinal sections of the latching slide 4—this slight angle (in the direction of the shaft 23) is visible in FIG. 7, and respective pairs of fingers face each other. Each pair of locking fingers 26, which act as separate added blocking bolts, enters the individual engagement slots 25 of a corresponding sleeve 22, when arranged flush and centered with respect to such sleeve. Two locking fingers 26 and two associated individual engagement slots 25 are each located in a transverse plane. The section of the blocking sleeve flange 22' between the engagement slots 25 remains as a blocking surface extending up to the sleeve's circumference. Each blocking sleeve 22 is also coupled to one number-setting dial 27. To provide actuating access to dials 27, they are mounted through slots 28 in the front plate 3. Blocking sleeves 22 are mounted for mutual rotation with respect to the number-setting dials 27 by engaging internal recesses 30 of the number-setting dials 27 by means of engagement projections 29. Near the dials 27, latching slide member 4 forms spaces between locking fingers 26 of sufficient width that flange 22' of the blocking sleeves 22, located toward the side of latching portion 5, as well as the number-setting dial 27, can project into the spaces. The respective angular position of the blocking sleeves 22 is secured by special stop springs 31 which enter notch-like stop-positions 27' (FIG. 7), divided at equal angles around the circumference of the number-setting dials 27. When dials 27 are locked in position in such a way that the individual engagement slots 25 of the blocking sleeves 22 coincide with the locking fingers 26, the latching slide member 4 can be shifted with the objective of achieving against the force of the spring F1, by means of manually urging the operating device H in the direction of arrow "x".

However, if any one of the blocking sleeves 22 has been turned to a different position by means of its respective number-setting dial 27 (which exhibit numerical symbols on its circumference), the shifting displacement of the latching slide member 4 is blocked. The latching function is, however, provided at any time by the available movement of the latching portion 5, independent of any unlocking or locking position. The corresponding blocking sleeve 22 located adjacent to the latching portion 5 is sufficiently separated from the dragging hook 11 to permit such independent latching movement.

For the purpose of changing the permutation, i.e., recoding the secret combination for opening the lock, the blocking sleeves 22 are positioned against the force of an additional and especially adjusted spring F2. This spring acts on the sleeves and is located in the space R (FIGS. 2 and 3), so as to be outside of the range of engagement of the sleeves with the number-setting dials 27; the sleeves 22 are shifted for recoding along shaft 23 in the direction opposite to the arrow "x". This shifting is controlled by means of a projecting part 32 positioned behind the left-most blocking sleeve 22 and acts directly on the rear face 22'' of the blocking sleeve 22 which it faces and whose end projects through its corresponding number-setting dial 27. The adjusting projection 32 is designed in the form of a cam 40 portion pivoting about a vertical axis in relation to the shaft 23. The cam 40 is provided with at least two contact surfaces 41, 42, arranged so as to be at an angle with respect to each other and corresponding to the two basic positions of the adjustment projection part 32. The contact surfaces 41, 42 have different distances to the cam axis, so that the desired release or disengagement of the number-setting dials 27 through dimension "St" (FIG. 1) is effected by rotation of the cam 40 and the change of the cam contact surfaces 41, 42 (e.g., see FIG. 2 and then FIG. 3). This shifts the blocking sleeves 22 for the distance "St" against the force of the blocking sleeve spring F2, thereby disengaging the blocking sleeves 22 from the number-setting dials 27, which can now be freely rotated. This normal radial blockage is, as previously mentioned, achieved by two diametrically opposite projections 29 of the blocking sleeve, which engage the corresponding recesses 30 of the axially stationary number-setting dials 27. This number-setting release dimension "St" corresponds essentially to the unlatching movement of the latching slide portion 5 through the travel "y" of this latching portion 5 in the opening direction.

When the position for recoding has been obtained, as shown in FIG. 3, the opening movement of the latching portion 5 is blocked. This blocking occurs because the flange portion 22' of the right-most blocking sleeve 22, between the two individual engagement slots 25 of the sleeve 22, now prevents drag-hook 11 of the latching portion 5 from being shifted in the opening (left) direction. The luggage or other case equipped with such a combination lock can therefore not be closed in this condition. Latching can only be accomplished again after completion of the recoding process, i.e., when the blocking sleeves 22 have returned to the blocking engagement position with respect to the number-setting dials 27 (FIG. 2). In this position, the frontal surface 22'' of the left-most sleeve 22 braces against the contact surface 41 of cam 40, which is mounted from the inside of the lock housing by way of a plug connection. The cam's shaft passes through a hole 44 of the support insert 19, as well as through a hole 45 of the lock casing 17 which coincides with the insert. The frontal surface of the cam 40, which faces the inside of the lock, ends directly beneath the shaft 23 and is secured in the insert's front wall 24, so that the adjustment projection 32, which is supported at its other end on the bottom of the insert (see FIG. 3), is axially fixed.

The second blocking sleeve spring F2, which is also accommodated in the space R toward the right of the lock housing, is shown in one embodiment in FIGS. 1–3 in the form of a "hairpin" spring, with the use of strip material. The width of this strip is preferably selected in such a way that the spring ends directly beneath the shaft 23, passing it at a right angle. One spring leg 46, which starts from the loop K, abuts on an intermediate wall 47. This wall is inserted into the transverse slot 18 of the insert 19, and also extends up to the lateral slots 20, thus forming a common bracing abutment both for the latching portion spring F1 and, acting in the opposite direction, also for the blocking sleeve spring F2. The section of the intermediate wall 47 bordering the space R is also advantageously subjected to relatively low stresses, because the forces of the springs F1 and F2, which act independently of each other, partially offset each other. The other portion of spring F2, namely convex spring leg 48, also starts from the loop K and abuts on the frontal surface of the blocking sleeve flange 22' (see FIG. 3). The blocking sleeve spring F2 is so dimensioned in length that it is fixed immovably in position because of its inherent geometry and the existing storage space section adjacent to the spring F2.

Figure 5:
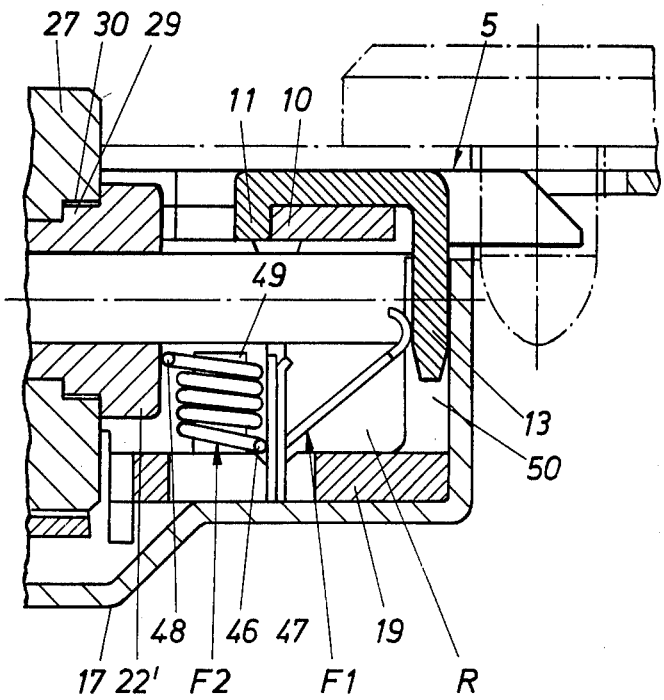
FIG. 5 represents a fragmentary longitudinal cross-sectional view of the representation shown in FIG. 4.
Figure 4:
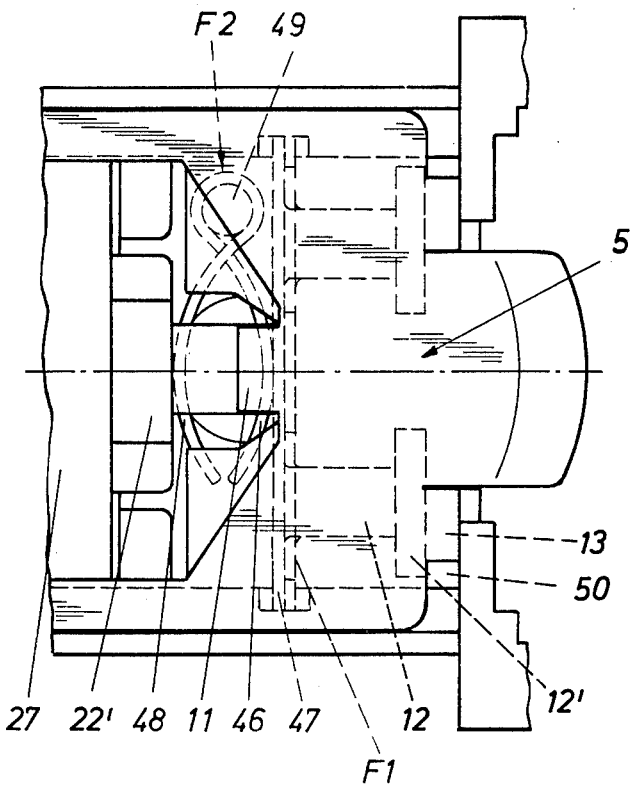
FIG. 4 is a fragmentary top plan view of the combination lock, showing in greater detail the blocking sleeve spring in the form of a helical spring.

In the embodiment of FIGS. 4 and 5, the blocking sleeve spring F2 takes the form of a helical spring. The coiled section is slipped on an upright stud 49 molded onto the insert 19. The helical portion exhibits a height corresponding to that of the stud 49. As with the embodiment of FIGS. 1–3, the spring leg 46 in this embodiment also braces against the intermediate wall 47 in the proximity of the transverse slot 18, while the other spring leg 48, which runs horizontally on the level of the upper end of stud 49, abuts against the frontal surface of the blocking sleeve flange 22'. Both of these spring legs (46, 48) are shaped convex in relation to the contact zone (see FIG. 4). The spring force is attained from the resistance of helical retraction.

Figure 6:
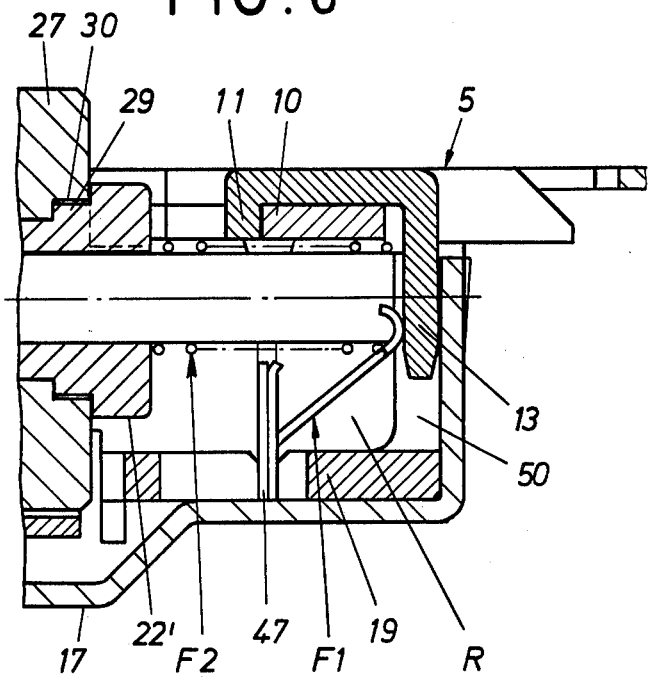
FIG. 6 is a fragmentary longitudinal sectional view of another variant of an arrangement of a blocking sleeve spring mounted on the lock shaft.

In the embodiment shown in FIG. 6, the blocking sleeve spring F2 is designed in the form of a screw-thread pressure spring slipped on the end of shaft 23 located there. The spring braces on one end against the front wall 24 and acts with its other end on the blocking sleeves 22 to urge the blocking engagement of sleeves 22 with the number-setting dials 27.

As a result of the free-standing design of the front walls 24 (FIGS. 1–3), free spaces 50 remain on both sides of this side wall 24, thereby permitting easier plug-in assembly of the latching portion 5, since the fork prong ends 12' of the latching portion spring F1 find their support on the inside of the lock housing 17 at front wall 24. These prong ends do not fill free spaces 50, allowing the bearing flanges 13 to be inserted unhindered into the free spaces.

Figure 7:
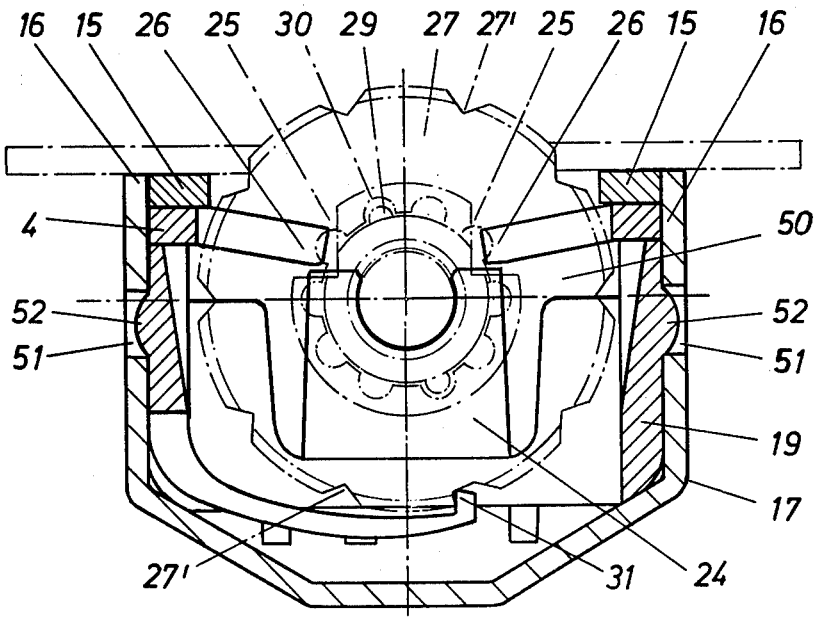
FIG. 7 shows a cross-sectional end view of the combination lock.

Referring to FIG. 7, the insert 19 itself is designed for clip-on connection. It is for this purpose provided on its longitudinal walls with 16 click-stop projections 52 snapping into openings 51 of the longitudinal walls of the lock housing 17. The interior part of the lock can be mounted in the insert 19 to achieve easier pre-assembly.

It is to be understood that the above-described embodiments are merely illustrative of the application of the principles of this invention. Numerous variations may be devised by those skilled in the art without departing from the spirit or scope of the invention.

What is claimed is:

1. A combination lock for suitcases, bags, or the like, with a fastening hasp having a main shaft, a plurality of engageable blocking sleeves and number-setting dials arranged on said shaft, the movement of said sleeves when the correct combination of said lock is set establishing engagement slots, a latching slide member having a pair of fingers adapted to be moved axially into said engagement slots, spring means for normally urging said latching slide member into a latched position, and a latching slide portion projecting from said latching slide member for selective latching engagement with said hasp, characterized by said latching being coupled to said latching slide member for axial movement with respect thereto, said spring means including a spring element for normally resisting said movement, at least one of said blocking sleeves having a flange portion occupying said engagement slots to exclude said fingers of said latching slide member therefrom, said fingers being spaced a predetermined distance from each other, whereby said axial movement of said latching slide portion is prevented, including a chamber for receiving said one of said blocking sleeves upon its disengagement from its respective one of said dials, wherein said spring means is normally housed in said chamber and includes a first spring to normally maintain said sleeves and said dials engaged and a second spring to normally maintain said latching slide portion in the latching position with said hasp, and further including a support housing having a mounting slot therein, and wherein said chamber has a partitioning wall to provide a base for the spring action of at least said first spring, said wall extending into said chamber adjacent to but spaced from said main shaft, wherein said second spring is a leaf spring having at least one prong-end, said lock further including an inner support housing with a wall portion thereof having an aperture aligned opposite said prong-end of said second spring.

2. A combination lock for suitcases, bags, or the like, with a fastening hasp having a main shaft, a plurality of engageable blocking sleeves and number-setting dials arranged on said shaft, the movement of said sleeves when the correct combination of said lock is set establishing engagement slots, a latching slide member having a pair of fingers adapted to be moved axially into said engagement slots, spring means for normally urging said latching slide member into a latched position, and a latching slide portion projecting from said latching slide member for selective latching engagement with said hasp, characterized by said latching slide portion being coupled to said latching slide member for axial movement with respect thereto, said spring means including a spring element for normally resisting said movement, at least one of said blocking sleeves having a flange portion occupying said engagement slots to exclude said fingers of said latching slide member therefrom, said fingers being spaced a predetermined distance from each other, whereby said axial movement of said latching slide portion is prevented, wherein said latching slide member includes a bridge extending across said look between opposite ends of said dials, and wherein said latching slide portion includes a pair of opposed prongs mounted for sliding movement relative to said bridge.

3. A combination lock including a chamber for receiving said one of said blocking sleeves upon its disengagement from its respective one of said dials, wherein said spring means is normally housed in said chamber and includes a first spring to normally maintain said sleeves and said dials engaged and a second spring to normally maintain said latching slide portion in the latching position with said hasp, wherein said latching slide member includes a bridge extending across said lock between opposite ends of said dials, and wherein said latching slide portion includes at least one flange bearing against said second spring and depending at an angle from said bridge.

* * * * *